United States Patent [19]

Leitz

[11] 4,024,952

[45] May 24, 1977

[54] SCREW CAP FOR A CONTAINER

[75] Inventor: Wilfried Leitz, Bad Krozingen, Germany

[73] Assignee: Koninklijke Emballage Industrie Van Leer B.V., Amstelveen, Netherlands

[22] Filed: Oct. 3, 1975

[21] Appl. No.: 619,257

[30] Foreign Application Priority Data

Oct. 3, 1974 Netherlands ..... 7413077

[52] U.S. Cl. ..... 206/221; 215/6; 215/DIG. 8; 220/23

[51] Int. Cl.[2] ..... B65D 1/04

[58] Field of Search ..... 220/22, 23; 215/6, DIG. 8, 215/227; 206/221, 219, 222; 128/272.1; 222/142.5

[56] References Cited

UNITED STATES PATENTS

| | | | |
|---|---|---|---|
| 2,787,268 | 4/1957 | Greenspan | 215/6 |
| 2,793,776 | 5/1957 | Lipari | 215/DIG. 8 |
| 3,081,137 | 3/1963 | Kolokythas | 220/23 |
| 3,239,429 | 3/1966 | Menolasino et al. | 220/23 |
| 3,326,400 | 6/1967 | Hamelin et al. | 220/23 |
| 3,840,136 | 10/1974 | Lanfranconi et al. | 215/DIG. 8 |
| 3,924,741 | 12/1975 | Kachur et al. | 215/6 |

*Primary Examiner*—William Price
*Assistant Examiner*—Joseph M. Moy
*Attorney, Agent, or Firm*—Stevens, Davis, Miller & Mosher

[57] ABSTRACT

A container with a screw cap having a compartment for holding a liquid or powdery material is disclosed. The compartment comprises a wall which engages with the inner side of the screwed sleeve of the container and a bottom section which is connected to the cap in such a manner that in opening the container the bottom section releases the contents of the compartment. The bottom section may be a disc which abuts against the lower edge of the wall of the compartment and which is connected to the cap.

9 Claims, 5 Drawing Figures

SCREW CAP FOR A CONTAINER

Figure 1:
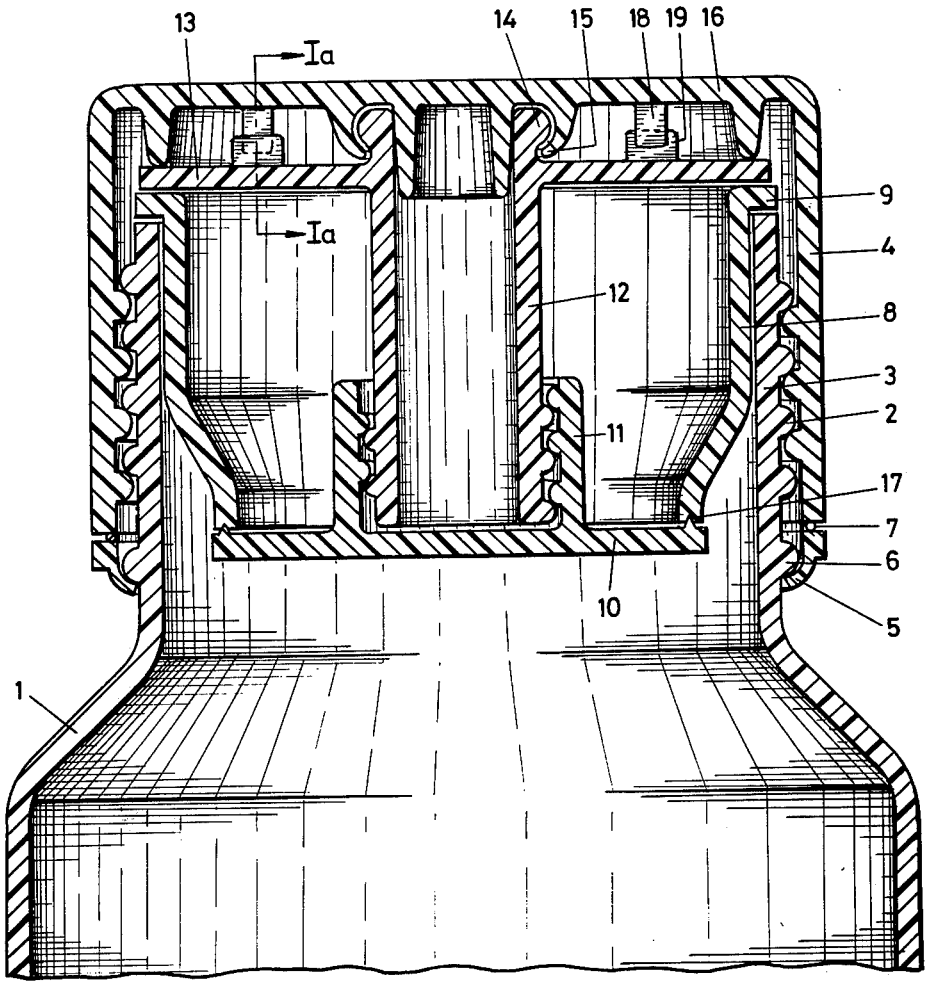

Containers provided with a screw cap are generally known in various embodiments, i.e., in either big or small sizes. When in these containers one material has to be stored which when being used is to be mixed with a second material, then the second material will usually be supplied in a separate container. Such a procedure is complicated and does not guarantee that the mixing of the two separated materials is carried out in the proper proportion.

It is an object of the present invention to offer an improvement and in accordance with the invention said object is achieved in that the cap has a compartment for holding a liquid or powdery material, said compartment comprising a wall which engages with the inner side of the screwed sleeve of the container, as well as a bottom section which is connected to the cap in such a manner that in opening the container said bottom section releases the contents of the compartment. In the most simple embodiment the container according to the invention has a compartment provided in the neck, said compartment being held in the neck of the container and the bottom of said compartment being opened as soon as the screw cap is unscrewed. This may occur, for instance, in that the compartment has a tear-off-strip in the bottom, connected to the cap. By unscrewing the cap it will move away from the screw neck of the container, however the compartment is held in said neck so that the compartment can be opened automatically, as a result of which the contents thereof mixes with the contents of the container. The compartment may have frictional contact with the inner side of the screw neck. However, it is also possible that the wall of the compartment engages the inner side of the screw neck by the fact that the wall with an edge or groove respectively engages with a groove or grips over an edge respectively or below an edge of the inner surface of the screw neck. The connection may, thus, be a clamping joint or a snap-action contact. In choosing the kind of joint it is important in which way the bottom section is connected to the screw cap.

The bottom section may consist of a disc which abuts against the lower edge of the wall of the compartment and which is connected to the cap, said connection may be broken when the cap is unscrewed. This kind of connection may consist of a screw-thread joint or a snap-action contact.

The most effective embodiment is obtained when the shank has a screw-thread-joint with the bottom section, forming a unity with a cover of the compartment and having a rotatable snap-action contact with the cap, in which cap and lid have mutually co-operating cams which when tightening the cap can slide over each other and which when unscrewing the cap are coupled with each other so that the lid is taken along by the cap. Thus, a compartment is obtained which may be filled and closed independently of the cap, which may be secured by the snap-action contact in the interior of the cap and subsequently reaches its position when the cap is screwed onto the container. When the cap is unscrewed again, the cams will take along the cover of the compartment, the wall of which compartment is being retained in the neck of the container, as a result of which the screw-thread-joint between shank and bottom section is unscrewed to the same extent as the cap is being unscrewed. The bottom section will then fall off shortly before or simultaneously with the release of the cap. Both screw-thread joints preferably have the same pitch.

Figure 1A:
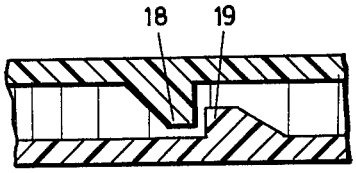
Figure 2:
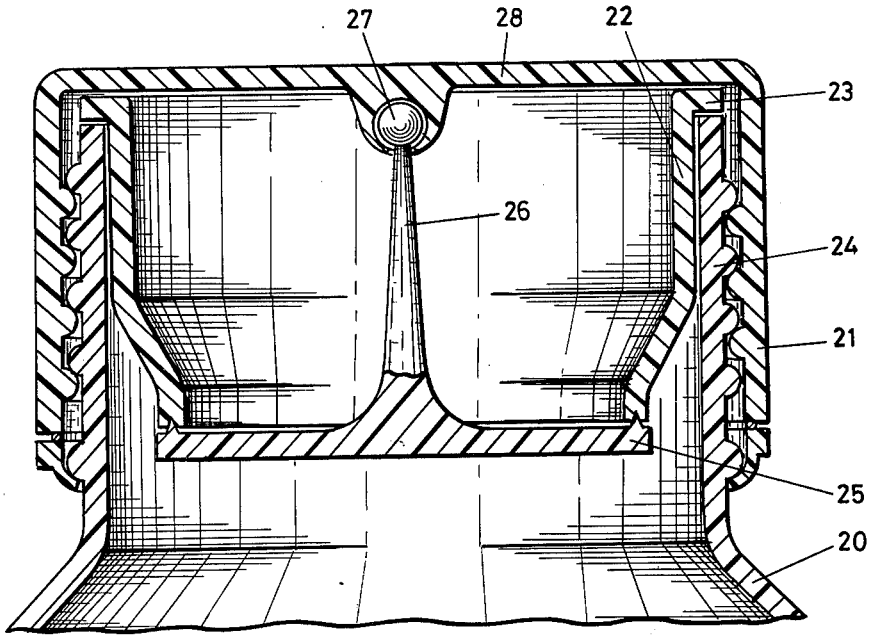
Figure 3:
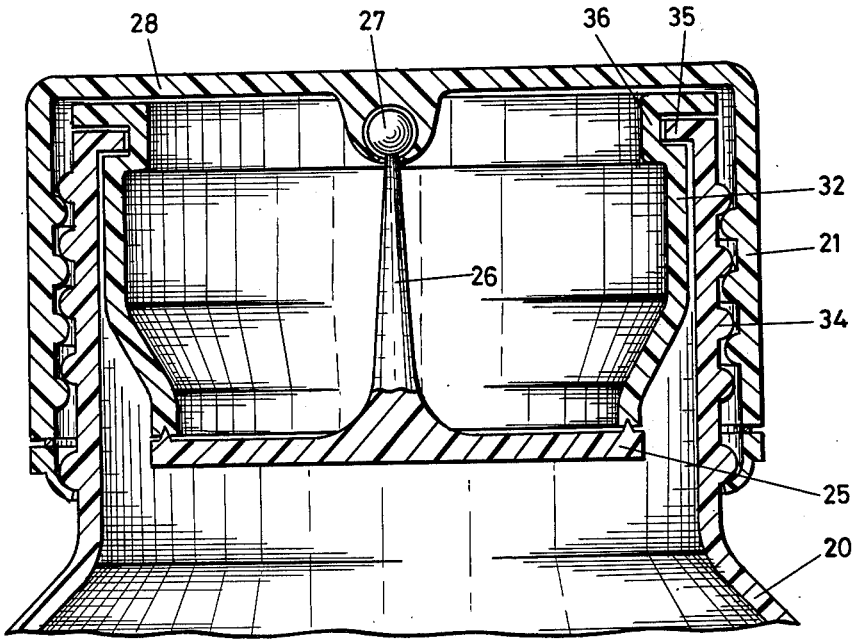
Figure 4:
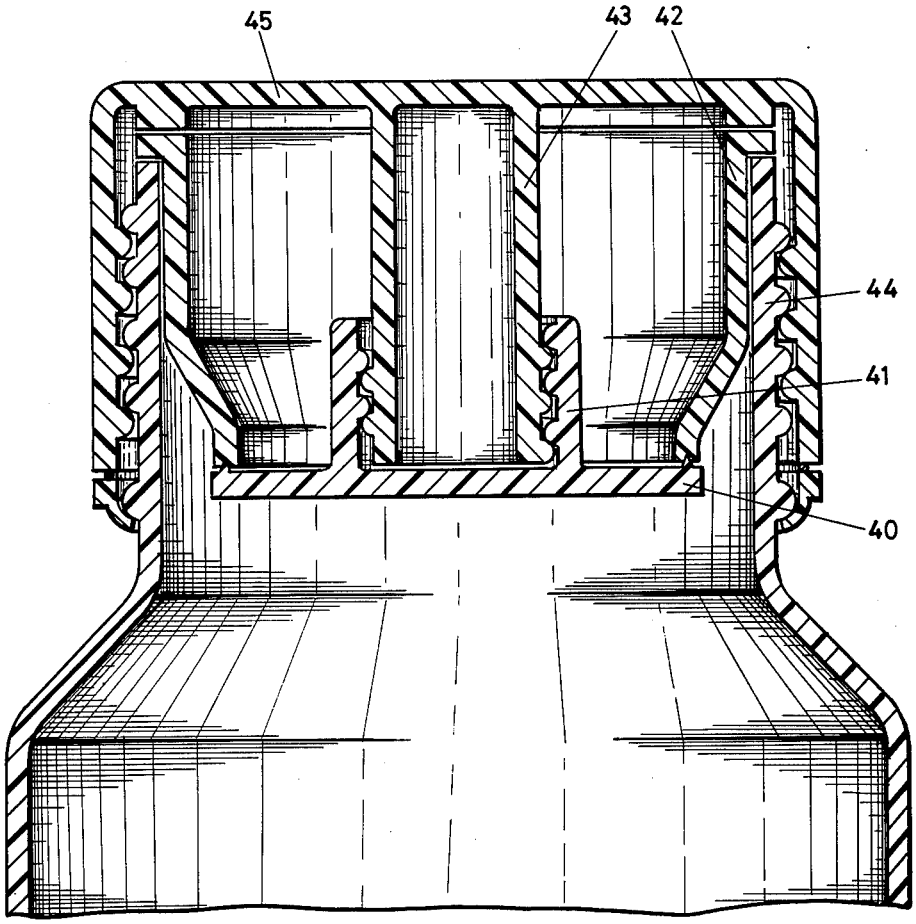

The above and other objects, features and advantages of the invention will become more apparent from the examination of the drawings; wherein FIG. 1 is a sectional view of a preferred embodiment;

FIG. 1*a* is a vertical sectional view taken on a line I*a*—I*a* of FIG. 1 and shows detail;

FIGS. 2, 3 and 4 are sectional views of other embodiments.

In the embodiment of FIG. 1 container 1 has a neck 3 provided with external threads 2, a cap 4 being screwed onto said neck, the interior of said cap being also provided with threads.

The lower part of the cap is provided with an edge 5 embracing a ledge 6 which is not part of the threads and which has a detachable link 7 with the cap wall 4.

A compartment comprising wall 8 and flange 9 is positioned in neck 3 of container 1, said wall is held in the neck and with flange 9 rests on the rim of the neck. In addition, the compartment comprises bottom 10 which has a sleeve 11 provided with threads, a shank 12 provided with threads engages with said sleeve, said shank being integral with lid 13 which has a snap-action contact 14, 15 with the upper wall 16 of the cap. Said snap-action contact is constructed in such a way that cap and lid may rotate with respect to each other about the vertical centre line. Bottom 10 has a knife edge sealing 17 with the lower edge of wall 8.

The compartment may be filled and closed after the filling by screwing the cover and shank 12 into the screw-thread sleeve 11 and, thus, pulling bottom and cover against the lower and upper edge respectively of wall 8. The filled and closed compartment is now positioned in the cap, in which a snap-action contact is effected by the fact that the circular beaded edge 14 pushes lips 15 aside. The entire structure is subsequently positioned on the neck of the container and the cap is screwed onto the neck whereby the compartment glides into the neck and frictional contact is established with the neck.

Cams 18 and 19 are located between cover 13 and upper wall 16 of the cap. As is illustrated in detail in FIG. 1*a*, the cams have such a tooth-profile that in the one direction they may slide over each other and in the other direction they will strike against each other with their vertical sides. It is herewith achieved that in screwing the cap onto the container, said cap is not obstructed in its screwing movement by the presence of the compartment. For the compartment is hindered to rotate by the friction with the neck of the container, whereas the cap is, indeed, rotated. The cams will then rattle over each other. When the cap is unscrewed, cams 18 will take along cams 19, which means that the cover of the compartment is turned and, therewith, also shank 12, as a result of which the screwed joint between shank 12 and bottom 10 is released.

In the embodiment illustrated in FIG. 2 the bottle or container 20 has a screw cap 21 with a compartment consisting of wall 22 and flange 23, said flange having frictional contact with neck 24. The compartment is closed by means of bottom plate 25, which in its centre portion has a shank 26 being an integral part thereof. Said shank has a rotatable snap-action contact 27 with the upper wall 28 of the cap. After filling the compartment, in which, of course, bottom 25 and wall 22 have to be kept pressed against each other, the cap is placed over the compartment, in which the snap-action contact 27 is established. Said contact should be such that flange 23 abuts with a slight pressure against the inner wall of the cap.

When the process of unscrewing takes place the compartment will remain in the neck by friction and the snap-action contact 27 will be released, as a result of which bottom 26 will be loosened and the contents of the compartment will mix with the contents of the container.

FIG. 3 illustrates a container with a screw cap which, in principle, corresponds with the embodiment of FIG. 2. The difference consists in that wall 32 of the compartment has a snap-action contact in axial direction with neck 34 because the neck is provided with an inwardly directed edge 35 and wall 32 of the compartment encloses said edge in a U-shaped manner illustrated by reference numeral 36.

In using elastic plastic type material said snap-action contacts can be constructed in a simple manner.

The joint illustrated in FIG. 3 is a better guarantee for keeping the wall of the compartment in the neck in axial direction when the cap is being unscrewed and, therewith, the unlocking of the snap-action contact 27 than the frictional contact illustrated in FIG. 2.

FIG. 4 illustrates an embodiment in which wall 42 of the compartment is secured in neck 44 in the same manner as illustrated in FIGS. 1 and 2. Bottom 40 of the compartment has a sleeve 41 provided with internal threads in the same manner as illustrated in FIG. 1, a shank 43 engaging in said sleeve 41, said shank, however, in this embodiment being integral with the upper wall 45 of the cap. Also this embodiment has the advantage that cap and compartment after filling the compartment can be placed as a unity into the neck when screwing the cap onto the container and that when said cap is unscrewed the compartment tends to remain behind, as a result of which the joint of bottom 40 with shank 43 is released.

Although the present invention has been described in some detail by way of illustration and example for purposes of clarity of understanding, it is understood that numerous changes and modifications may be practiced within the spirit of the invention as limited only by the scope of the claims appended hereto.

I claim:

1. A container having a screw threaded neck and a screw cap, said cap having a compartment therein for holding material, said compartment being defined by a separate annular wall in frictional contact with the inner surface of the screw-threaded neck and a bottom, means releasably connecting said bottom and the cap for pressing said bottom upwardly against the lower edge of the annular wall, said means being so constructed that said cap is rotatable with respect to the bottom and that upon unscrewing of said cap, said bottom is released.

2. Container in accordance with claim 1, characterized in that the wall of the compartment engages with the inner side of the screw neck by the fact that the wall has an edge or groove which respectively engages over an edge respectively or below an edge of the inner surface of the screw neck.

3. Container in accordance with claim 1, characterized in that the bottom comprises a disc, said disc abutting against the lower edge of the wall of the compartment, and said means releasably connecting the bottom and the cap may be broken when said cap is unscrewed.

4. Container in accordance with claim 3, characterized in that the bottom has a screw-threaded joint with a shank, said shank being secured to the cap.

5. Container in accordance with claim 4, characterized in that the shank is integral with a cover of the compartment, said shank having a rotatable snap-action contact with the cap and the cover and the cap have mutually cooperating cams, said cams in tightening the cap may slide over each other, however, in unscrewing the cap said cams are coupled with each other in such a way that the cover is taken along by the cap.

6. Container in accordance with claim 4, characterized in that the pitch of the screw cap equals that of the screw joint between the bottom of the compartment and the shank being in connection with the cap.

7. Container in accordance with claim 3, characterized in that the means releasably connecting the bottom and the cap comprises a shank, said shank being integral with the bottom and having a rotatable snap-action contact with the cap.

8. A container according to claim 1, wherein:

the cross-sectional area of the bottom is less than that defined by the inner surface of the neck.

9. A container according to claim 1 , wherein:

the inner surface of said neck is circular in cross-section, said bottom comprises a disc, and the cross-sectional area of said bottom is less than that defined by the inner surface of the neck.

* * * * *